United States Patent [19]

Kato et al.

[11] 4,318,719

[45] Mar. 9, 1982

[54] ELECTRODE FOR AN ELECTRIC DUST COLLECTOR

[76] Inventors: Hisashi Kato, 596-75, Sonobe, Wakayama-shi, Wakayama-ken; Sadao Toyoda, 27-2, Shinsenriminamimachi 2-chome, Toyonaka-shi, Osaka-fu, both of Japan

[21] Appl. No.: 151,924

[22] Filed: May 21, 1980

[30] Foreign Application Priority Data

Jun. 8, 1979 [JP] Japan ..... 54-72594

[51] Int. Cl.[3] ..... B03C 3/47; B03C 3/64

[52] U.S. Cl. ..... 55/147; 55/155; 55/DIG. 38

[58] Field of Search ..... 55/140, 147, 154–156, 55/DIG. 38; 252/511

[56] References Cited

U.S. PATENT DOCUMENTS

| | | | |
|---|---|---|---|
| 2,841,241 | 7/1958 | Eilenberger | 55/147 |
| 3,457,537 | 7/1969 | Hines | 252/511 |
| 3,837,145 | 9/1974 | Festner | 55/155 |
| 4,066,576 | 1/1978 | Bork et al. | 252/511 |
| 4,090,984 | 5/1978 | Lin et al. | 252/511 |
| 4,155,792 | 5/1979 | Gelhaar et al. | 55/DIG. 38 |
| 4,214,969 | 7/1980 | Lawrance | 252/511 |

FOREIGN PATENT DOCUMENTS

| | | | |
|---|---|---|---|
| 2500888 | 7/1976 | Fed. Rep. of Germany | 55/154 |
| 52-47705 | 5/1977 | Japan | 55/154 |
| 1436826 | 5/1976 | United Kingdom | 55/154 |

*Primary Examiner*—David L. Lacey
*Attorney, Agent, or Firm*—Erwin S. Teltscher

[57] ABSTRACT

An electrode for an electrically operable dust collector comprises a corrosion-resistant rigid frame, which has a relatively small coefficient of expansion, and a flexible conductive sheet secured under stress to the frame, and including a fiber cloth device, and a flexible material device coating the fiber cloth device; one of the devices is predominantly conductive, the other of the devices is substantially nonconductive.

14 Claims, 19 Drawing Figures

ELECTRODE FOR AN ELECTRIC DUST COLLECTOR

BACKGROUND OF THE INVENTION

1. Field of the Invention

The present invention relates to an improvement in an electrode utilized in an electric dust collector, and more particularly, it relates to a dust collection electrode which comprises a flexible conductive sheet securely held in a frame.

2. Description of the Prior Art

In recent years, an electric dust collector is widely employed in the art for removing dust from waste gas in factories as an apparatus for preventing air pollution. In a conventional wet type electric dust collector treating corrosion type gas such as sulfur dioxide below the dew point, the electrode is formed by rigid fiberglass reinforced plastic (hereinafter abbreviated as F.R.P.) having high corrosion resistance. However, the electrode made of F.R.P. is easily deformed and distorted, and especially under a high temperature around 100° C., it is exceedingly deformed.

On the other hand, the conventional electric dust collector has been made large-sized in recent years, and therefore a large dust collection electrode has been utilized, though, it is difficult to produce a large F.R.P. electrode which is not easily deformed. Further, a large electrode is awkward to transport and difficult to handle in case of repair and replacing.

SUMMARY OF THE INVENTION

It is an object of the present invention to overcome the aforementioned disadvantages of the prior art by providing an electrode for an electric dust collector, which is highly resistant against corrosion type gas and shows substantially no deformation or distortion.

It is another object of the present invention to provide an electrode for an electric dust collector which can be easily manufactured and is easy to transport even if large-sized.

It is still another object of the present invention to provide an electrode for an electric dust collector which is easy to repair and replace following assembly.

According to the present invention, there is provided a dust collection electrode which comprises a flexible conductive sheet secured under stress to a rigid frame of predetermined size. The conductive sheet has high mechanical strength, and is coated on both major surfaces by material highly corrosion-resistant with respect to a corrosive gas such as acid alkali. The conductive sheet is preferably soft so that it can be rolled, and the sheet and/or the coating material is conductive. When the sheet is to be made conductive, it is formed by fiber cloth (fibrous sheet) which is conductive and has a high mechanical strength such as carbon fiber cloth, graphite fiber cloth and metal fiber cloth, and is coated on both of its surfaces by corrosion-resistive flexible material. The carbon fiber cloth is preferably made of acrylic fiber treated at a baking temperature of about 1000° C., and the specific resistance thereof is about $10^{-2}$ to $10^{-3}\Omega$ cm, its tensile strength is about $15\times10^5$ Kg/cm$^2$, its coefficient of elasticity is about $13\times10^5$ Kg/cm$^2$ and its thermal expansion coefficient is about $3\times10^{-6}$ to $5\times10^{-6}$/°C. The graphite fiber cloth is preferably made of acrylic fiber treated at a baking temperature of about 2000° C., and the specific resistance thereof is $10^{-4}$ to $10^{-5}\Omega$ cm, its tensile strength is about $9\times10^3$ Kg/cm$^2$, its coefficient of elasticity is about $25\times10^5$ Kg/cm$^2$ and its coefficient of linear expansion is about $17\times10^{-6}$/°C. The coating material is prepared by soft synthetic resin such as epoxy resin, silicone resin and polyvinyl chloride resin, or soft synthetic rubber or natural rubber such as nitril butadiene rubber, chloroprene and styrene butadiene rubber. In general, the specific resistance of a compound of resin and rubber is about $10^6$ to $10^{10}\Omega$ cm. However, when the compound is utilized as material for coating carbon fiber cloth or graphite fiber cloth, the specific resistance of the entire conductive sheet is made about $10^0$ to $10^{-2}\Omega$ cm.

On the other hand, when the sheet is made of nonconductive fiber cloth and the coating material is to be made conductive, the sheet is formed by nonconductive fiber cloth such as glass fiber cloth, synthetic fiber cloth or natural fiber cloth such as cotton and jute, and is coated by a material containing fine particles of a conductive substance such as carbon black, graphite and conductive metal. The coating material may be prepared by fluoric resin or various kinds of rubber. The amount of the conductive substance to be contained in the coating material is determined so that the coating material is made sufficiently conductive, and varies with the required specific resistance. If the surface resistance of the conductive sheet is preferably below $10^3\Omega$ cm, 10 to 40% by weight of the conductive substance is to be contained in the coating material.

The sheet may be prepared by a strong composite layer made by the superposition of conductive fiber cloth and nonconductive fiber cloth, coated by a material containing or not containing a conductive substance, respectively. Thickness, size and combination of the sheet and the coating material can be appropriately determined as required. Forming of the coating layer on the fiber cloth is conducted by uniformly infiltrating the sheet with an unhardened synthetic resin solution or unvulcanized rubber mixed with a vulcanizing agent or coating the aforementioned material by a calender. Then the coating layer formed on the fiber cloth is hardened to provide the conductive sheet. Since the coating material is prepared by polyvinyl chloride resin or chloroprene, the layer becomes soft and flexible after hardening. Further, since the conductive sheet comprises fiber cloth and a soft coating layer formed thereon, it is so flexible that it can be rolled.

The rigid frame to which the conductive sheet is secured is made of rigid material resistive against corrosive gas such as acid alkali and the rate of expansion and contraction of which against any temperature change, i.e., its coefficient of expansion is small; the material may be such as titanium, Hastelloy or F.R.P. having a high rigidity. Thus, the electrode according to the present invention can be made flat by securing the conductive sheet to a certain quadrilateral rigid frame. Further, the electrode according to the present invention can be formed in a suspended manner by mounting rigid bars of certain length to the upper and lower portions of the conductive sheet formed in certain quadrilateral shape and securing the upper bar to the upper portion of the sheet. Still further, the electrode according to the present invention can be made tubular by forming the rigid frame square or circular in section and spreading the conductive sheet on the outer periphery of the rigid frame. The tubular electrode thus constructed may be made in the suspended manner by mounting quadrilateral or circular rigid members to the upper and the lower portions of the conductive sheet and securing the upper rigid bar to the upper portion of the electrode. The rigid frame is secured to the conductive sheet by placing two rigid frames on both surfaces of the conductive sheet and passing set pins through the frames so that the conductive sheet is held between the frames or forming in the frame a groove into which the end of the conductive sheet is inserted and secured thereto by screw bolts.

In case the sheet is made of carbon fiber cloth, graphite fiber cloth, metal fiber cloth or glass fiber cloth and the coating material is made of heat-resisiting resin such as silicone resin and fluoric resin, a heat-resisting conductive sheet which can resist high temperature of about 200° C. is formed.

DESCRIPTION OF THE PREFERRED EMBODIMENTS

Figure 1:
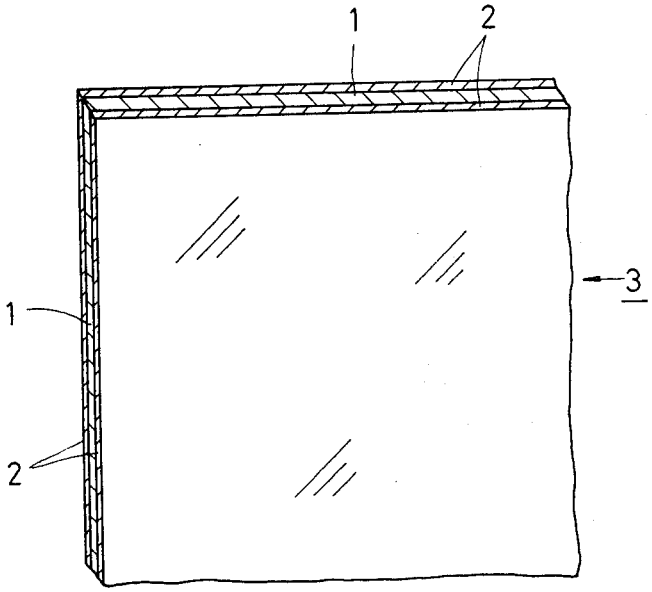
FIG. 1 is an illustrative view showing a part of a conductive sheet embodying the present invention.

Referring now to FIGS. 1 to 4 of the drawings in which a first embodiment of the present invention is shown, numeral 1 indicates a thin conductive carbon fiber cloth of a predetermined size and coated for protection with a pair of substantially nonconductive coating layers 2, which are formed by coating the outer surfaces of the carbon fiber cloth 1 with unvulcanized silicone rubber mixed with a vulcanizing agent and 20% of carbon black by means such as a calender and then vulcanizing the silicone rubber. The coating layers 2 may be formed by impregnating the carbon fiber cloth 1 in unvulcanized silicone rubber. The carbon fiber cloth 1 is about 0.5 mm thick and each coating layer 2 is about 0.05 mm thick, and a conductive sheet 3 thus formed is 3000 mm wide by 9000 mm long.

Figure 2:
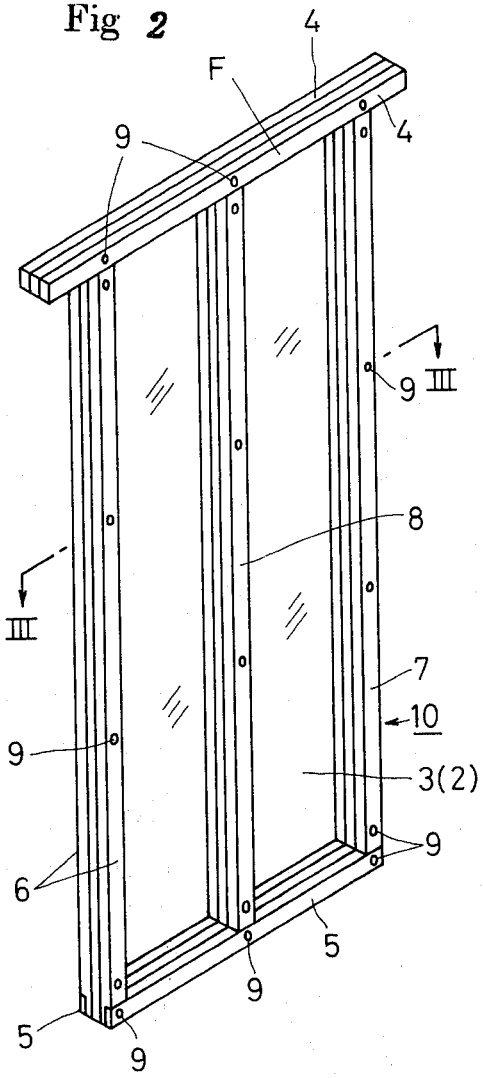
FIG. 2 is a perspective view of a dust collection electrode utilizing the conductive sheet of FIG. 1.
Figure 3:
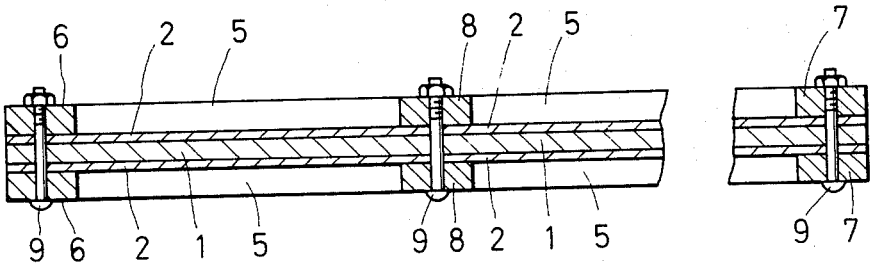
FIG. 3 is an enlarged cross sectional view taken along lines III—III of FIG. 2.
Figure 4:
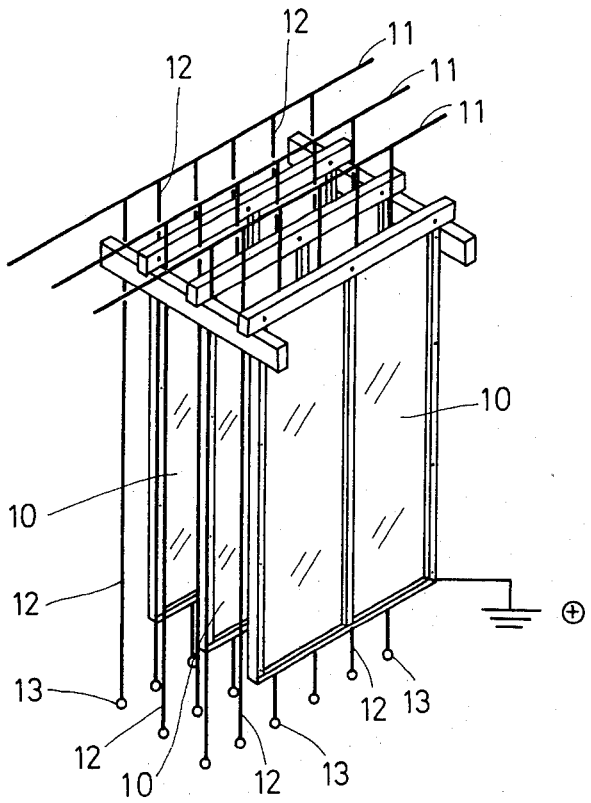
FIG. 4 is an illustrative view showing operational condition of the electrode.
Figure 5:
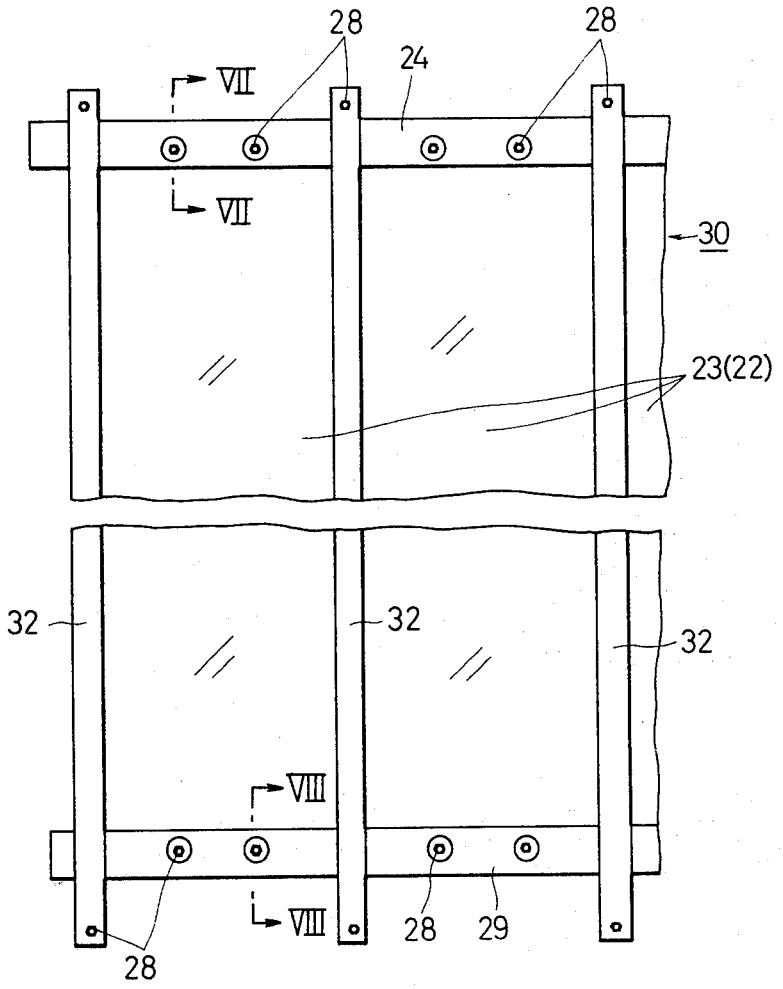
FIG. 5 is an illustrative view showing the principal part of a second embodiment of the present invention.
Figure 6:
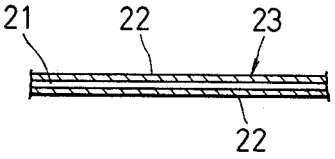
FIG. 6 is an illustrative view showing construction of the conductive sheet.
Figure 7:
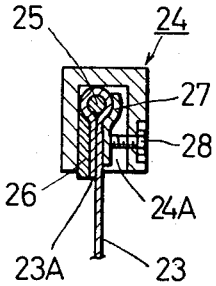
FIG. 7 is a cross sectional view taken along lines VII—VII of FIG. 5.
Figure 8:
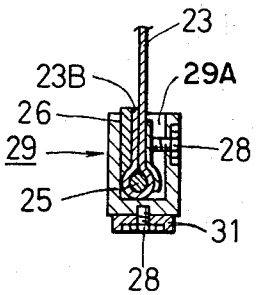
FIG. 8 is a cross sectional view taken along lines VIII—VIII of FIG. 5.
Figure 9:
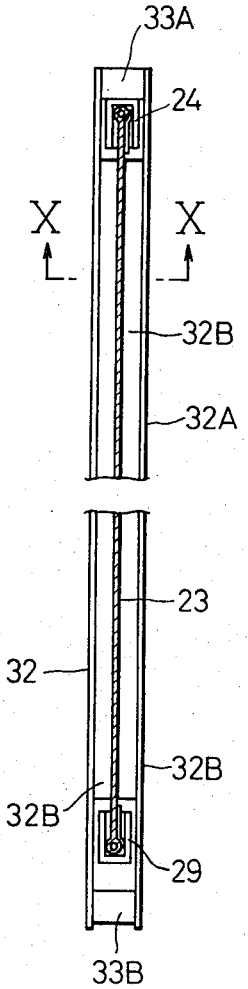
FIG. 9 is a fragmentary side elevational view of the dust collection electrode.
Figure 10:
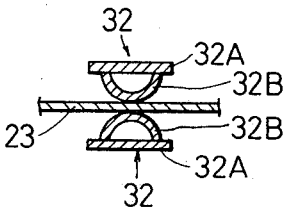
FIG. 10 is a cross sectional view taken along lines X—X of FIG. 9.

As shown in FIG. 2, a rigid frame 5 is prepared by a pair of upper bars 4, a pair of lower bars 5, two pairs of vertical bars 6 and 7 and a pair of reinforcing bars 8 for assembling a dust collection electrode. The rigid frame F is made of SUS 316L which is acid resistant, and which has an expansion coefficient of $16.5\times10^{-6}/°$ C. The upper bar 4 is 30 mm wide by 3200 long and 5 mm thick, the lower bar is 30 mm wide by 3000 mm long and 5 mm thick, and each of the vertical bars 6 and 7 and the reinforcing bar 8 is 30 mm wide by 9000 mm long and 5 mm thick. The conductive sheet 3 is secured to the rigid frame F. Namely, the upper and the lower short edges, the left and the right long edges and the longitudinal center of the conductive sheet 3 are interposed between the upper and the lower bars 4 and 5, the vertical bars 6 and 7 and the reinforcing bars 8 respectively so that the conductive sheet 3 is secured within the rigid frame F by a plurality of screws 9 to form a dust collection electrode 10 for an electrical dust collector (see FIG. 4). In this electric dust collector, the dust collection electrodes 10 are provided at certain intervals to be grounded with plus terminals, and between each two adjacent electrodes 10, a plurality of minus discharge plates 12 are suspended by weights 13 from a lead wire 11 to discharge electricity between the poles. The dust collector thus constructed was adapted to treat exhaust gas under a temperature of about 100° C., of which the principal ingredient was $SO_2$ for about one year, without any problem. The following Table shows the comparison in properties of the dust collection electrode 10 according to the present invention and a conventional rigid electrode made of F.R.P. before and after use for one year:

TABLE

| | deformability (mm) | | specific resistance (Ω cm) | | |
|---|---|---|---|---|---|
| | before use | after use | before use | after use | corrosion resistance |
| invention | ±1 | ±2 | $3\times10^{-2}$ | $7\times10^{-2}$ | no changes observed |
| prior art | ±10 | ±20 | $2\times10^{2}$ | $4\times10^{4}$ | partially corroded |

The aforementioned F.R.P. electrode is made of polyester resin containing carbon fiber therewithin, and is 3000 mm wide by 9000 mm long and 3 mm thick.

It is clearly seen from the Table that the dust collection electrode 10 according to the present invention shows very small changes in deformability and specific resistance in comparison with the conventional electrode.

Attention is now drawn to FIGS. 5 to 16 of the drawings, in which a second embodiment of the present invention is shown. A conductive sheet 23 of this embodiment comprises glass cloth 21 made of glassfiber and a pair of coating layers 22 formed by coating unvulcanized rubber mixed with 30% of fine particles of graphite by a calender and vulcanizing the same. Numeral 24 indicates an upper bar which has a groove 24A to receive the upper portion of the conductive sheet 23. The upper portion of the conductive sheet 23 is bent at 23A along a round bar 25, and a pair of stoppers 26 and 27 made of material identical with that of the sheet 23 or another packing material are applied to both sides of the bent portion 23A so that the upper portion of the conductive sheet 23 is inserted into the groove 24A and secured thereto by screws 28. Since the screws 28 do not pass through the conductive sheet 23, it can be evenly secured to the upper bar 24 without any substantial deformation or distortion.

Numeral 29 indicates a lower bar having a groove 29A adapted to receive the lower portion of the conductive sheet 23. Similar to the upper portion, the lower portion of the conductive sheet 23 is bent at 23B along another round bar 25, and another pair of stoppers 26 and 27 are applied to both sides of the bent portion 23B so that the lower portion of the conductive sheet 23 is inserted into the groove 29A and secured thereto by screws 28. In a dust collection electrode 30 of this embodiment, the upper bar 24 is fixed at both ends and the lower bar 29 is suspended by its own weight so as to strain the surface of the electrode 30. Therefore, when the lower bar 29 is not sufficiently heavy, a weight 31 is secured to the bottom thereof by the screws 28. When the lower bar 29 is preferably heavier, the weight 31 may be mounted to the outer surface of the lower bar 29.

A plurality of vertical bars 32 are provided on both surfaces of the conductive sheet 23 for preventing vibration thereof. Each of the vertical bars 32 comprises a strip-shaped plate 32A provided in its inner surface with a semicircular portion 32B, which is placed with respect to the upper and the lower bars 24 and 29 in close contact such that the strained condition of the conductive sheet 23 by virtue of certain load is not affected by the same, and thereby prevents vibration of the conductive sheet 23.

Each pair of the vertical bars 32 are secured by bolts with interposition of a pair of spacers 33A and 33B, though, the lower bar 29 is maintained in a suspended condition without having affected thereby.

Figure 11:
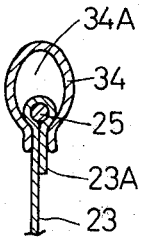
FIGS. 11 to 13 are illustrative views showing modifications of means for securing the conductive sheet to the upper member of the frame.
Figure 12:
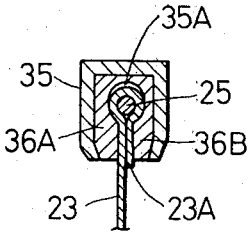

The upper and the lower bars 24 and 29, and the vertical bars 32 are made of rigid material such as sufficiently conductive F.R.P. or metal, corrosion-resisting coated metal and plastic laminate of carbon fiber cloth or graphite fiber cloth selected at need. The means for securing the upper and the lower bars 24 and 29 to the conductive sheet 23 are not limited to those mentioned above. Namely, the end of the conductive sheet 23 bent along the round bar 25 may be transversely inserted into an upper or lower bar 24 having a groove 34A which is U-shaped in section and of which ends are tightened and secured thereafter as shown in FIG. 11. Or, the end of the conductive sheet 23 bent along the round bar 25 may be held between two separate stoppers 36A and 36B to be inserted in a groove 35A of an upper U-shaped bar 35, of which, as viewed in cross section, are bent inwardly under pressure as shown in FIG. 12. Further, the bent portion of the conductive sheet 23 may be covered by a protection member.

Figure 13:
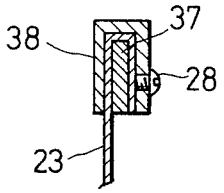

The upper and the lower bars are preferably secured to the conductive sheet 23 without forming any screw holes in the sheet 23 so as to prevent distortion by deflection of the conductive sheet 23. FIG. 13 shows the U-shaped cross-section of an upper bar 38 into which the end of the conductive sheet 13 bent along a rectangular bar 37 is inserted and secured by a screw 28.

Figure 14:
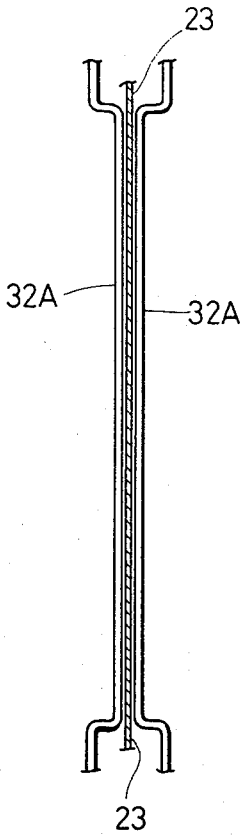
FIG. 14 is an illustrative view showing an embodiment of a vertical bar for preventing vibration of the conductive sheet.
Figure 15:
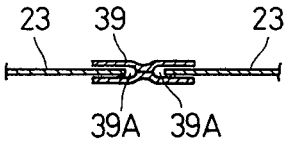
FIGS. 15 and 16 are illustrative views showing means for holding the ends of the conductive sheets.
Figure 16:
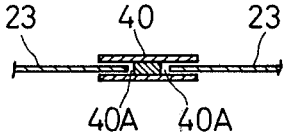

FIG. 14 shows a modification of the vertical bars for preventing vibration of the conductive sheet 23, in which a pair of strip-shaped plates 32A are bent inwardly to be adjacent to both surfaces of the conductive sheet 23, thereby simplifying the construction. When two or more conductive sheets 23 are connected with each other, the strip-shaped plates 32A may be utilized at the connected portions. Further, as shown in FIGS. 15 and 16, the ends of the conductive sheets 23 to be connected may be held by a strip-shaped plate 39 or 40 having a pair of grooves 39A or 40A in both sides, respectively.

Figure 17:
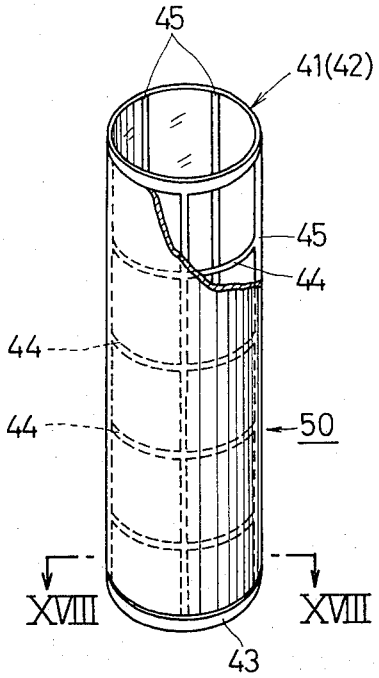
FIG. 17 is a partially fragmentary perspective view of a third embodiment of the present invention.
Figure 18:
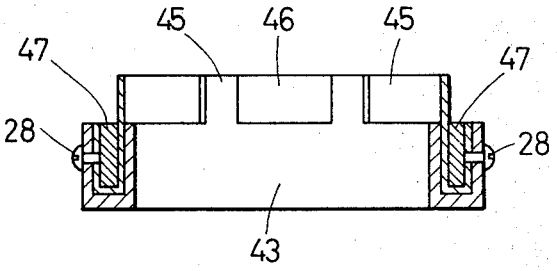
FIG. 18 is a partially fragmentary illustrative view taken along lines XVII—XVII of FIG. 17.

While the electrodes 10 and 30 of the first and the second embodiments are of a flat type comprising the rigid frames F and the conductive sheets 3 and 23, a third embodiment provides a cylindrical electrode. In FIGS. 17 and 18 showing the third embodiment, numeral 41 indicates a rigid frame for forming a cylindrical dust collection electrode 50, which comprises an annular upper member 42, an annular lower member 43 separated in a certain space from the upper member 42, a plurality of reinforcing members 44 and a plurality of vertical bars 45. Numeral 46 indicates a conductive sheet comprising carbon fiber cloth coated by silicone rubber, the composition of which is identical with that of the conductive sheet 3 of the first embodiment. The conductive sheet 46 is stretched along the outer periphery of the rigid frame 41 to form a cylindrical dust collection electrode 50. The upper and the lower ends of the conductive sheet 46 are inserted in grooves formed in the upper and the lower members 42 and 43 with stoppers 47 and secured thereto by screws 28.

Figure 19:
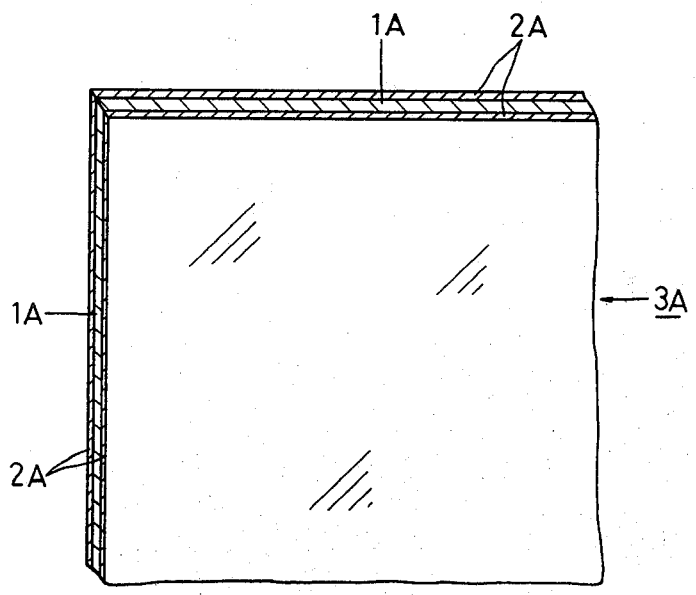
FIG. 19 is a perspective view of another embodiment of the present invention.

A fourth embodiment of the electrode is shown in FIG. 19. As already disclosed on page 4, lines 3 to 6, a strong composite layer 1A is obtained by superimposing or combining a conductive fiber cloth, such as carbon fiber cloth, graphite fiber cloth, or metal fiber cloth, and a substantially non-conductive fiber cloth, such as a glass fiber cloth, synthetic fiber cloth, or natural fiber cloth. A coating layer 2A of substantially non-conducting, flexible material, such as rubber or synthetic resin, is coated onto each side of the composite layer 1A as a coat 2A to form a resultant flexible conductive sheet 3A.

As hereinabove described, the dust collection electrode according to the present invention comprises a fiber cloth sheet coated by flexible material such as synthetic resin strainedly secured under stress to a rigid frame which is corrosion resistant and to which the expansion coefficient is small. Therefore, it is especially suited for dust collection of dust from a corrosion type gas with substantially no deformation or distortion of the electrode taking place. Further, since the fiber cloth and/or the coating material of the sheet is conductive, the entire surface of the electrode is made conductive to effectively collect dust.

Since the electrode according to the present invention is simple is construction, it can be easily made large-sized. Further, the electrode according to the present invention is convenient in transportation since the bulky conductive sheet can be transported separately in the form of a roll and easily assembled with the rigid frame when required for use. Still further, the electrode according to the present invention is easy to handle in the case of repair and/or replacement.

While the invention has been described with reference to a few preferred embodiments thereof, it is to be understood that modifications or variations may be easily made without departing from the scope of this invention which is defined by the appended claims.

What is claimed is:

1. An electrode for an electrically operable dust collector, comprising in combination:

a corrosion-resistant rigid frame, having a relatively small coefficient of expansion, and a flexible predominantly conductive sheet secured under stress to said frame, and including fiber cloth means having two major sides, and a flexible material means including a soft type synthetic resin or rubber coating at least one of said sides of said fiber cloth means, one of said means being predominantly conductive, the other of said means being substantially nonconductive.

2. The electrode as defined in claim 1 wherein said rigid frame is made of material selected from a group consisting of titanium, Hastelloy and fiberglass reinforced plastic.

3. The electrode as defined in claim 1 wherein said electrode is in the form of a flat plate.

4. The electrode as defined in claim 1 wherein said electrode is in the form of a cylinder.

5. The electrode as defined in claim 1, wherein said fiber cloth means is the predominantly conductive means which includes carbon fiber cloth having a specific resistance of about $10^{-2}$ to $10^{-3}$ $\Omega$ cm, tensile strength of about $15\times10^5$ Kg/cm$^2$, a coefficient of elasticity of about $13\times10^5$ Kg/cm$^2$ and a thermal expansion coefficient of about $3\times10^{-6}$ to $5\times10^{-6}$/° C.

6. The electrode as defined in claim 1, wherein said fiber cloth means is the predominantly conductive means which includes graphite fiber cloth having a specific resistance of about $10^{-4}$ to $10^{-5}$ $\Omega$ cm, a tensile strength of about $9\times10^3$ Kg/cm$^2$, a coefficient of elasticity of about $25\times10^5$ Kg/cm$^2$, and a thermal expansion coefficient of about $17\times10^{-6}$/° C.

7. The electrode as defined in claim 1, wherein said fiber cloth means is the substantially nonconductive means which is selected from the group consisting of glass fiber cloth, synthetic fiber cloth and natural fiber cloth.

8. The electrode as defined in claim 1, wherein said flexible material means is the predominantly conductive means, and contains a conductive substance, said flexible sheet being thereby rendered predominantly conductive

9. The electrode as defined in claim 8, wherein the conductive substance is selected from the group consisting of carbon black, graphite and metal.

10. The electrode as defined in claim 1, wherein said fiber cloth means is the predominantly conductive means, said flexible sheet being thereby rendered predominantly conductive, and further comprising a substantially nonconductive fiber cloth disposed with an inner side thereof on the other and noncoated major side of said conductive fiber cloth means, and forming together with said conductive fiber cloth means a composite layer, said flexible material means being further disposed on an outer side of said nonconductive fiber cloth.

11. The electrode as claimed in claim 24, wherein said fiber cloth means is the predominantly conductive means, said flexible sheet being thereby rendered predominantly conductive, and further including nonconductive fiber cloth superimposed on said predominantly conductive fiber cloth means.

12. The electrode as defined in claim 11 wherein said conductive fiber cloth means is selected from a group consisting of carbon fiber cloth, graphite fiber cloth and metal fiber cloth.

13. The electrode as claimed in claim 1, wherein said flexible material means is the substantially nonconductive means.

14. A cylindrical electrode for an electrically operable dust collector, comprising in combination:

a corrosion-resistant rigid frame, having a relatively small coefficient of expansion, and made of a material selected from a group consisting of titanium, Hastelloy and fiberglass reinforced plastic, and a flexible predominantly conductive sheet secured under stress to said frame, and including substantially nonconductive fiber cloth means selected from the group consisting of glass fiber cloth, synthetic fiber cloth and natural fiber cloth, and a flexible material means coating said fiber cloth means, and including a soft type synthetic resin or rubber containing at least 10% to about 40% of fine particles of a conductive substance by weight.

* * * * *

UNITED STATES PATENT OFFICE

CERTIFICATE OF CORRECTION

Patent No. 4,318,719 Dated March 9, 1982

Inventor(s) Hisashi Kato and Sadao Toyoda

It is certified that error appears in the above-identified patent and that said Letters Patent are hereby corrected as shown below:

Col.8, line 15, change " as claimed in claim 24 " to -- as claimed in claim 1 --.

Signed and Sealed this

Sixth Day of July 1982

[SEAL]

Attest:

GERALD J. MOSSINGHOFF

Attesting Officer

Commissioner of Patents and Trademarks